US010316451B2

(12) United States Patent
Alexander et al.

(10) Patent No.: US 10,316,451 B2
(45) Date of Patent: Jun. 11, 2019

(54) LAUNDRY TREATING APPLIANCE

(71) Applicant: WHIRLPOOL CORPORATION, Benton Harbor, MI (US)

(72) Inventors: Benjamin E. Alexander, Stevensville, MI (US); Brent M. Burgess, Edwardsburg, MI (US); Christopher A. Jones, Saint Joseph, MI (US); Aaron A. Linden, Sandwich, IL (US); Dale E. Mueller, Benton Harbor, MI (US); Michele A. Paustian, Kalamazoo, MI (US); Brenner M. Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 482 days.

(21) Appl. No.: 14/809,451

(22) Filed: Jul. 27, 2015

(65) Prior Publication Data

US 2017/0030002 A1 Feb. 2, 2017

(51) Int. Cl.

| | |
|---|---|
| ***D06F 37/24*** | (2006.01) |
| ***D06F 23/04*** | (2006.01) |
| *D06F 33/02* | (2006.01) |

(52) U.S. Cl.

CPC ..... *D06F 37/245* (2013.01); *D06F 23/04* (2013.01); *D06F 33/02* (2013.01)

(58) Field of Classification Search

CPC ..... D06F 37/245; D06F 23/04; D06F 33/02
USPC ..... 68/3 R, 23.4, 23.2, 23.3, 12.06; 8/159
See application file for complete search history.

(56) References Cited

U.S. PATENT DOCUMENTS

| | | | | |
|---|---|---|---|---|
| 2,575,691 | A * | 11/1951 | Smith | D06F 13/00 210/360.1 |
| 2,836,301 | A | 5/1958 | Bruckman | |
| 4,528,827 | A | 7/1985 | Largen | |
| 5,513,504 | A | 5/1996 | Sribar et al. | |
| 6,082,151 | A * | 7/2000 | Wierzba | D06F 37/245 68/23.2 |
| 7,757,324 | B2 | 7/2010 | Leidig et al. | |
| 7,900,305 | B2 | 3/2011 | Leidig et al. | |
| 8,156,769 | B2 | 4/2012 | Leidig et al. | |
| 2011/0120194 | A1* | 5/2011 | Leidig | D06F 37/225 68/131 |
| 2013/0036776 | A1 | 2/2013 | Seo et al. | |

FOREIGN PATENT DOCUMENTS

| | | |
|---|---|---|
| GB | 739666 | 11/1955 |

* cited by examiner

*Primary Examiner* — Michael E Barr
*Assistant Examiner* — Tinsae B Ayalew
(74) *Attorney, Agent, or Firm* — McGarry Bair PC

(57) ABSTRACT

A laundry treating appliance includes a rotatable basket defining a treating chamber for receiving a load of laundry items for treatment, and an annular balance rings defining an annular chamber within, coupled with the basket for rotation therewith. The basket can further comprise a pair of walls comprising a perforated inner wrapper and an outer wall defining a space therebetween. The space fluidly couples to the annular chamber, permitting liquid to flow from the treating chamber, into the space and into the annular chamber to provide a restoring force to the system. The annular balance ring can further comprise a plurality of passages, fluidly coupling the treating chamber to the annular chamber.

10 Claims, 8 Drawing Sheets

LAUNDRY TREATING APPLIANCE

BACKGROUND

Laundry treating appliances, such as washing machines, clothes dryers, refreshers, and non-aqueous systems, can have a configuration based on a rotating basket that defines a treating chamber in which laundry items are placed for treating. In a vertical axis washing machine having a basket and a tub, both the basket and tub typically have an upper opening at their respective upper ends. A balance ring can be coupled with the upper end of the basket to counterbalance a load imbalance that can occur within the treating chamber during a cycle of operation.

Traditional balance rings are pre-filled with liquid, such that a balance ring with a predetermined amount of liquid is designed to restore balance at a predetermined rotational frequency in which an imbalance condition can occur. However, these balance rings can create an imbalance condition while the basket rotates at a frequency different from the predetermined frequency, and are not adaptive to imbalance conditions occurring at variable frequencies or having varying degrees of imbalance.

BRIEF SUMMARY

A laundry treating appliance for treating laundry according to a cycle of operation includes a rotatable dual-wall basket having an outer wall and an inner perforated wrapper defining a space therebetween; wherein the rotatable dual-wall basket is configured to receive a wash liquid and a load. The dual-wall basket rotates about a generally vertically axis of rotation. An annular chamber provided at the top of the basket inside the outer wall has, at least, one fluid passage in communication with the space and an axis coincident with the axis of rotation. When an out-of-balance condition is cause by a skewed axis of rotation of the basket, wash liquid is urged from the basket to flow into the annular chamber via the at least one fluid passage to provide a restoring force to the basket toward a balanced condition. The balanced condition allows the wash liquid to flow from the annular chamber to the basket via the at least one fluid passage.

A method of operating a laundry treating appliance to restore balance during an out-of-balance condition comprising, rotating a basket, having an outer imperforate wall and an inner wrapper with perforations, such that liquid within the basket is moved radially by centrifugal force through the perforations into a space defined between the outer wall and the inner wrapper. The method further comprises moving the liquid into an annular chamber provided at the top of the basket in fluid communication with the space, utilizing the centrifugal force. The method further comprising restoring balance to the laundry treating appliance utilizing a restoring force provided by the liquid within the annular chamber and draining the liquid from the annular chamber after balance has been restored to the laundry treating appliance.

DETAILED DESCRIPTION

Figure 1:
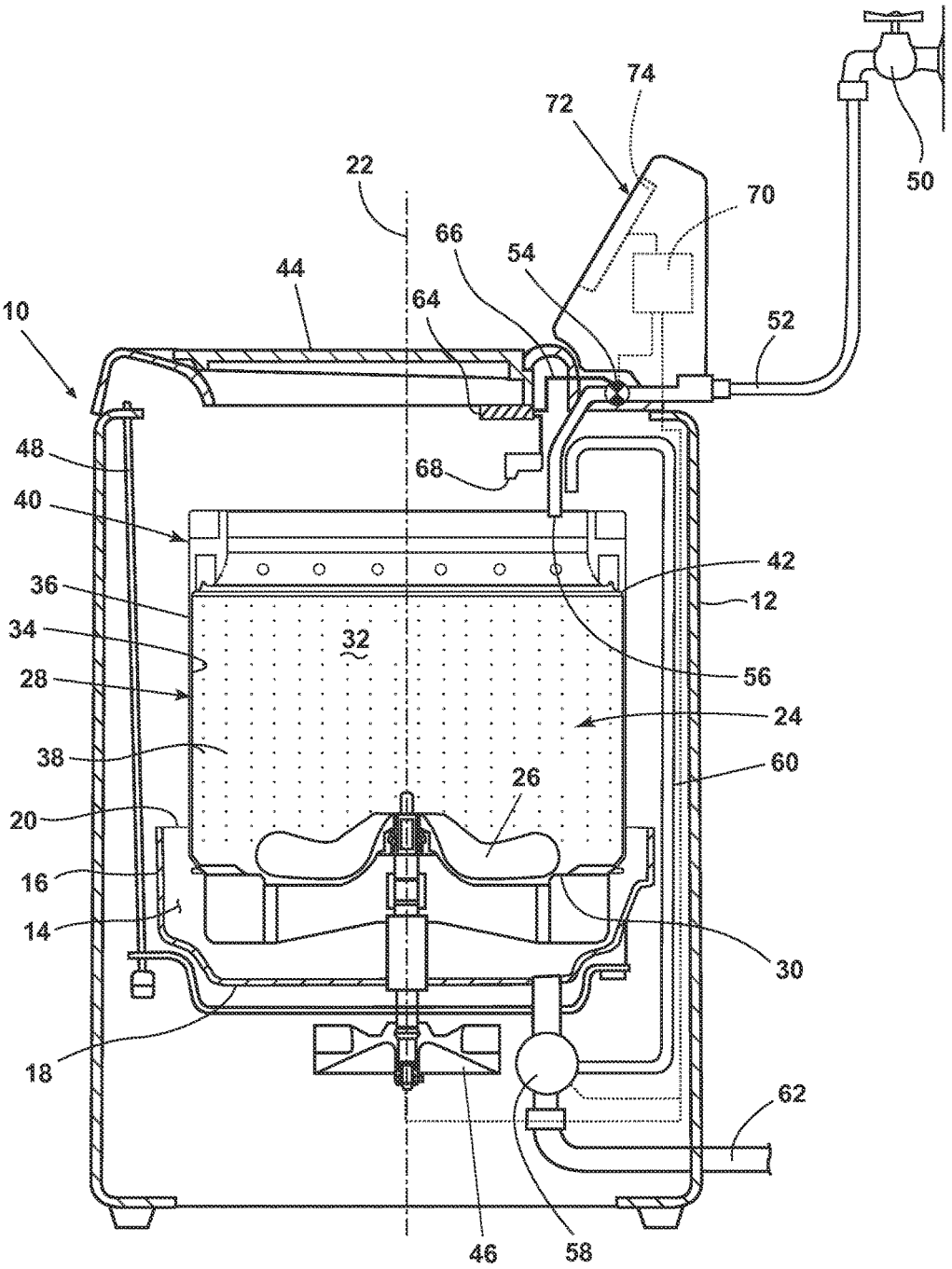
FIG. 1 illustrates a schematic sectional view of a laundry treating appliance in the form of a washing machine according to a first embodiment of the invention.

FIG. 1 is a schematic sectional view of a laundry treating appliance in the form of a washing machine 10 according to one embodiment of the invention. While the laundry treating appliance is illustrated as a vertical axis, top-fill washing machine, the embodiments of the invention can have applicability in other laundry treating appliances, non-limiting examples of which include a combination washing machine and dryer, a refreshing/revitalizing machine, an extractor, or a non-aqueous washing apparatus.

The washing machine 10 can include a structural support system comprising a cabinet 12 that defines a housing within which a laundry holding system resides. The cabinet 12 can be a housing having a chassis and/or a frame, defining an interior that receives components typically found in a conventional washing machine, such as motors, pumps, fluid lines, controls, sensors, transducers, and the like. Such components will not be described further herein except as necessary for a complete understanding of the invention.

The laundry holding system of the illustrated exemplary washing machine 10 can include a tub 14 installed in the cabinet 12. The tub 14 can have a generally cylindrical side or peripheral wall 16 closed at its bottom end by a base 18 that can at least partially define a sump. An upper edge 20 of the peripheral wall 16 can define an opening to an interior of the tub 14 for holding liquid.

A perforated basket 24 can be mounted in the tub 14 for rotation about an axis of rotation 22, such as, for example, a central, vertical axis extending through the center of a laundry mover 26 in the form of an impeller, as an example, located within the basket 24. Other exemplary types of laundry movers include, but are not limited to, an agitator, a wobble plate, and a hybrid impeller/agitator.

The basket 24 can have a generally cylindrical side or peripheral wall 28 closed at its bottom end by a basket base 30 to form an interior at least partially defining a laundry treating chamber 32 receiving a load of laundry items for treatment. The peripheral wall 28 can further be a dual wall, comprising an inner wrapper 34 and an outer wall 36. The inner wrapper 34 can include a plurality of apertures or perforations 38 such that liquid supplied to the basket 24 can flow through the perforations 38 to the tub 14. A balance ring assembly 40 can couple with the basket 24 to counterbalance a load imbalance that can occur within the treating chamber 32 during a cycle of operation, as described in further detail below. The illustrated balance ring assembly 40 is provided at the top or an upper edge 42 of the basket 24. The top of the cabinet 12 can include a selectively openable lid 44 to provide access into the laundry treating chamber 32 through an open top of the basket 24. While the embodiments of the invention are described in the context of a washing machine having a rotatable basket located within a tub, it will be understood that the embodiments can also be used in a washing machine, which has an imperforate drum without a tub.

A drive system including a drive motor 46, which can include a gear case, can be utilized to rotate the basket 24 and the laundry mover 26. The motor 46 can rotate the basket 24 at various speeds, including at a spin speed wherein a centrifugal force at the inner surface of the basket peripheral wall 28 is 1 g or greater; spin speeds are commonly known for use in extracting liquid from the laundry items in the basket 24, such as after a wash or rinse step in a treating cycle of operation. The motor 46 can also oscillate or rotate the laundry mover 26 about its axis of rotation during a cycle of operation in order to provide movement to the load contained within the laundry treating chamber 32.

A suspension system 48 can dynamically hold the tub 14 within the cabinet 12. The suspension system 48 can dissipate a determined degree of vibratory energy generated by the rotation of the basket 24 and/or the laundry mover 26 during a treating cycle of operation. Together, the tub 14, the basket 24, and any contents of the basket 24, such as liquid and laundry items, define a suspended mass for the suspension system 48.

The washing machine 10 can be fluidly connected to a liquid supply 50 through a liquid supply system including a liquid supply conduit 52 having a valve assembly 54 that can be operated to selectively deliver liquid, such as water, to the tub 14 through a liquid supply outlet 56, which is shown by example as being positioned at one side of the tub 14. The liquid supply 50 can be a household water source.

The washing machine 10 can further include a recirculation and drain system having a pump assembly 58 that can pump liquid from the tub 14 through a recirculation conduit 60 for recirculation of the liquid back into the treating chamber 32 and/or to a drain conduit 62 to drain the liquid from the washing machine 10.

The washing machine 10 can also be provided with a dispensing system for dispensing treating chemistry to the basket 24, either directly or mixed with water from the liquid supply 50, for use in treating the laundry according to a cycle of operation. The dispensing system can include a dispenser 64 which can be a single use dispenser, a bulk dispenser, or a combination of a single use and bulk dispenser. Water can be supplied to the dispenser 64 from the liquid supply conduit 52 by directing the valve assembly 54 to direct the flow of water to the dispenser 64 through a dispensing supply conduit 66. In this case, the valve assembly 54 can be a diverter valve having multiple outlets such that the diverter valve can selectively direct a flow of liquid to one or both of the liquid supply outlet 56 and the dispensing supply conduit 66. Furthermore, the dispenser can fluidly couple to a dispenser outlet 68 for supplying treating chemistry from the dispenser to the treating chamber 32.

It is noted that the illustrated drive system, suspension system, liquid supply system, recirculation and drain system, and dispensing system are shown for exemplary purposes only and are not limited to the systems shown in the drawings and described above. For example, the liquid supply, dispensing, and recirculation and drain systems can differ from the configuration shown in FIG. 1, such as by inclusion of other valves, conduits, treating chemistry dispensers, sensors (such as water level sensors and temperature sensors), and the like, to control the flow of liquid through the washing machine 10 and for the introduction of more than one type of treating chemistry. For example, the liquid supply system and/or the dispensing system can be configured to supply liquid into the interior of the tub 14 not occupied by the basket 24 such that liquid can be supplied directly to the tub 14 without having to travel through the basket 24. In another example, the liquid supply system can include separate valves for controlling the flow of hot and cold water from the household water source. In another example, the recirculation and drain system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a control system for controlling the operation of the washing machine 10 to implement one or more treating cycles of operation. The control system can include a controller 70 located within a console 72 on top of the cabinet 12, or elsewhere, such as within the cabinet 12, and a user interface 74 that is operably coupled with the controller 70. The user interface 74 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
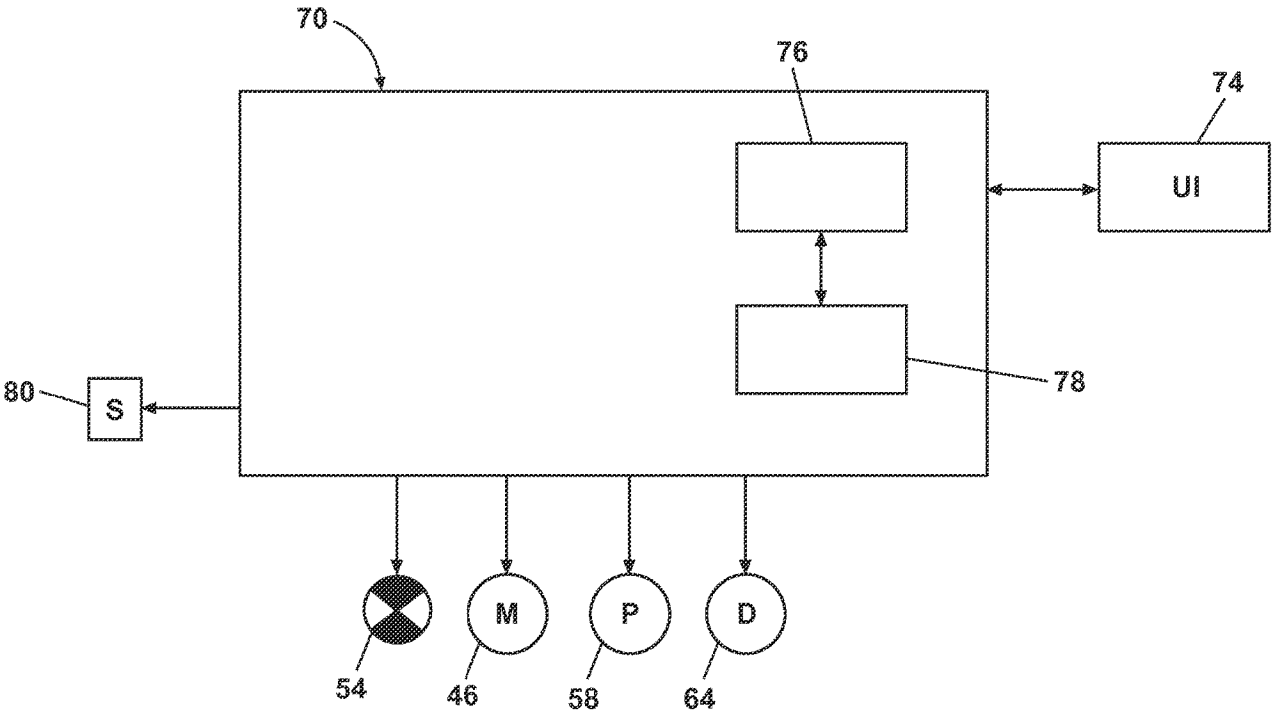
FIG. 2 illustrates a schematic view of a control system of the laundry treating appliance of FIG. 1.

FIG. 2 is a schematic view of the control system of the washing machine 10. The controller 70 can be provided with a memory 76 and a central processing unit (CPU) 78. The memory 76 can be used for storing the control software that is executed by the CPU 78 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 76 can also be used to store information, such as a database or table, and to store data received from one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and controlling the operation of the component to complete a cycle of operation. For example, the controller 70 can be operably coupled with the motor 46, the valve assembly 54, the pump assembly 58, the dispenser 64, and any other additional components that can be present such as a steam generator and/or a sump heater (not shown) to control the operation of these and other components to implement one or more of the cycles of operation. The controller 70 can also be coupled with one or more sensors 80 provided in one or more of the systems of the washing machine 10 to receive input from the sensors, which are known in the art and not shown for simplicity.

The basket 24, tub 14, laundry mover 26, motor 46 and any liquid or laundry in the treating chamber 32 and tub 14 can be thought of as a mass that is suspended from the cabinet 12 by the suspension system 48. The suspension system 48 has various dynamic modes that can change depending on the rotational speed of the basket 24, especially when laundry within the treating chamber 32 is non-uniformly distributed relative to the axis of rotation 22 and forms an imbalance.

During operation of the washing machine 10, when a load imbalance occurs, the imbalance can induce the basket 24 to deviate off its anticipated rotational path and move in a side-to-side direction, which can be referred to as a pendulum mode because the suspended mass is essentially swinging back and forth on the suspension system 48 within the cabinet 12. Such back and forth swinging can result in the washing machine 10 "walking" across the surface on which it rests, and/or the basket 24 can collide with the tub 14 and/or cabinet 12, which is noisy and can cause wear or damage to the machine 10 if left unchecked. A vertical travel mode is another dynamic mode that occurs when the suspended mass starts reciprocating up and down due to a load imbalance, which in severe cases can cause part of the basket 24 or tub 14 to contact the cabinet 12, causing related movement of the washing machine 10.

The rotational speed of the basket 24 at which pendulum mode and vertical travel mode are present is typically a function of the structure of the specific appliance. For example, the side-to-side movement can occur between 50-90 rotations per minute (rpm) as the basket 24 transitions to speeds where the laundry tends to "satellize" within the basket 24. That is, the centrifugal force applied to the laundry is sufficient for the laundry to "stick" to the basket 24 and not move relative to the basket. The pendulum mode tends to correspond to a first natural frequency of the suspended mass. Also for example, in the illustrated washing machine 10 the vertical travel mode can occur around 170-240 rpm. The vertical travel mode tends to correspond to a second natural frequency of the suspended mass. If imbalance during one of these modes becomes significant during a cycle of operation, a user may need to stop the cycle to redistribute or remove part of the load in the basket 24.

Traditional fluid-filled balance ring assemblies can mitigate the effects of load imbalance during a steady state, high speed spin, but the pre-filled rings are tuned to a particular frequency and cannot readily adapt to variable degrees of imbalance which can occur based upon load size, liquid density, as well as other factors. The speed at which a balance ring assembly can effectively mitigate the effects of load imbalance can be referred to as a critical speed. Below the critical speed, traditional fluid-filled balance ring assemblies have been found to add to or exacerbate an imbalance.

Embodiments of the present invention provide for a balance ring assembly that can correct imbalances in an adaptive manner based upon the degree of the imbalance, even at rotational speeds below critical. The balance ring assembly 36 can be configured to adapt to a dual wall system, filling itself with liquid to correct an imbalance and draining itself when the balance has been corrected.

Figure 3:
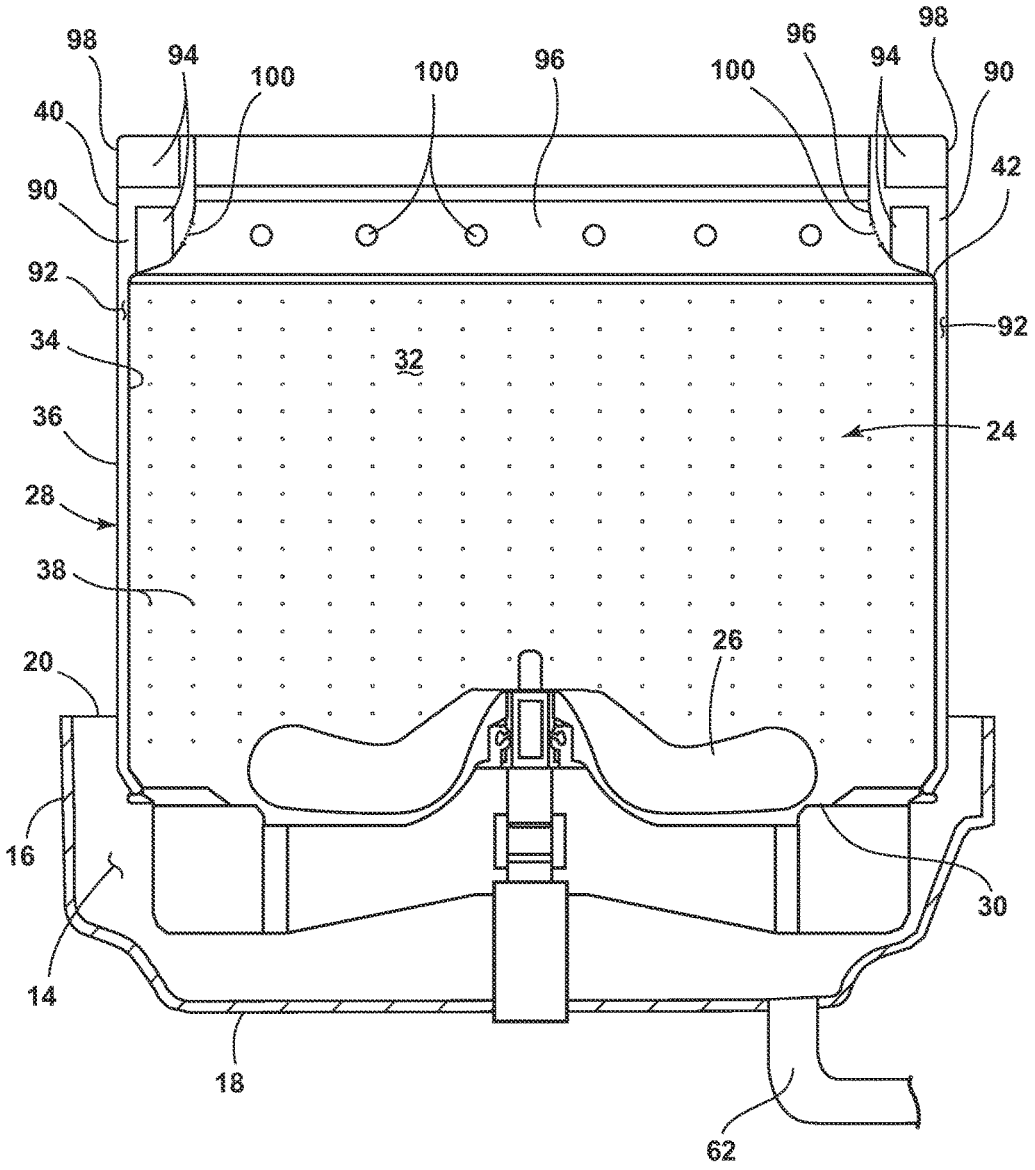
FIG. 3 illustrates a closer sectional view of the balance ring assembly, the basket, and the tub, according to the first embodiment of the invention in FIG. 1.

FIG. 3 is a sectional view of the balance ring assembly for the washing machine 10 of FIG. 1 according to a first embodiment of the invention. The basket peripheral wall 28 can be a dual wall, defining a space 92 between the inner wrapper 34 and the outer wall 36. The balance ring 40, having an inner surface 96 and an outer surface 98, defines an annular chamber 90 in fluid communication with the space 92. The outer surface 98 can mount to the outer wall 36, while the inner surface 96 can mount to the inner wall 34 at the basket upper edge 42. The balance ring 40 can further comprise a plurality of baffles 94 mounted within the annular chamber 90. The inner surface 96 of the balance ring 40 can be further comprise a plurality of passages 100, providing fluid communication between the annular chamber 90 and the treating chamber 32.

Figure 4:
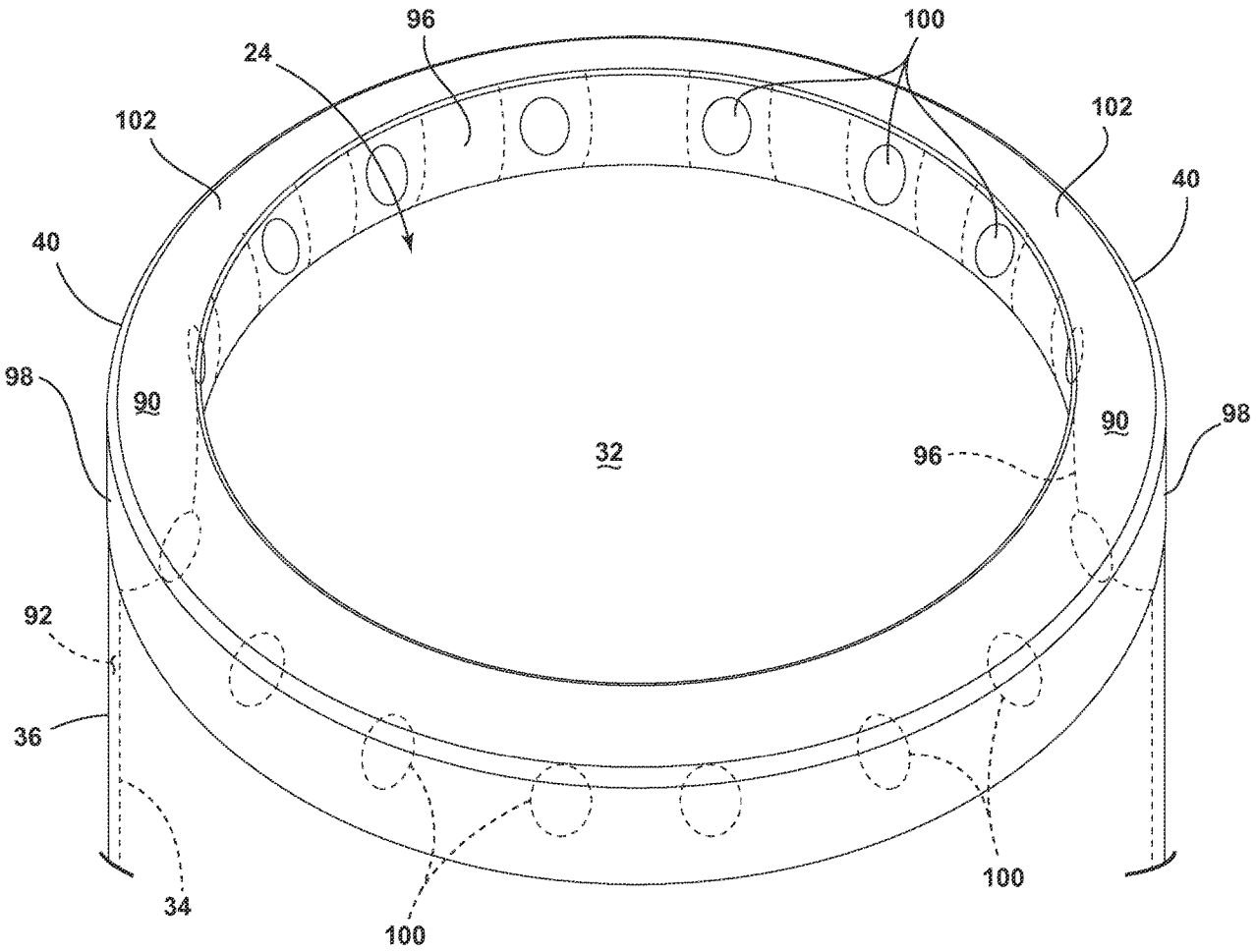
FIG. 4 is a top perspective view of the balance ring assembly of FIG. 3.

Turning to FIG. 4, the balance ring 40 can further comprise an upper surface 102. The upper surface 102, inner surface 96 and outer surface 98 form a substantially triangular-like cross section to the annular ring, with the inner surface 96 comprising a curved convex shape and interconnecting the upper surface 102 to the inner perforated wrapper 34. In variations, the balance ring 40 can be of multiple, variable shapes, with or without an upper wall, or having additional walls defining an annulus, such that a cross-section can define a plurality of shapes, with said shapes being circular, symmetrical, asymmetrical, geometrical, unique, or variable, or any other shape, such that an annular chamber 90 is disposed around the top of the basket 24 in fluid communication with the space 92, the treating chamber 32, or both.

Furthermore, the passages 100 can be disposed on the inner surface 96 of the balance ring, or any other surface which can fluidly couple the annular chamber 90 to the treating chamber 32. The passages 100 can be of variable shapes as well. Non-limiting examples can be circular, oval, quadrilateral, triangular, truncated geometry, random, variable, or any other shape adapted fluidly couple the treating chamber 32 to the annular chamber 90.

The shape of the balance ring 40, as well as the combination of passages 100, can be defined by the particular laundry treating device in order to optimally correct any imbalance which can occur. For example, the annular chamber 90 should be adapted such that range rotational frequencies causing an imbalance, or varying degrees of angular imbalance from an initial vertical axis of rotation, can be corrected. The balance ring 40 defining the annular chamber 90, baffles 94, and passages 100, can be shaped or sized based upon the size or orientation of the treating chamber 32, the basket 24 or even the space 92 between the inner wrapper 34 and the outer wall 36. Additionally, the balance ring 40 can be sized or shaped to restore an imbalance at a variable frequency at which the suspension system can create an imbalance, based upon a variable suspended mass or anticipated mass within the treating chamber 32 or basket 24.

Figure 5B:
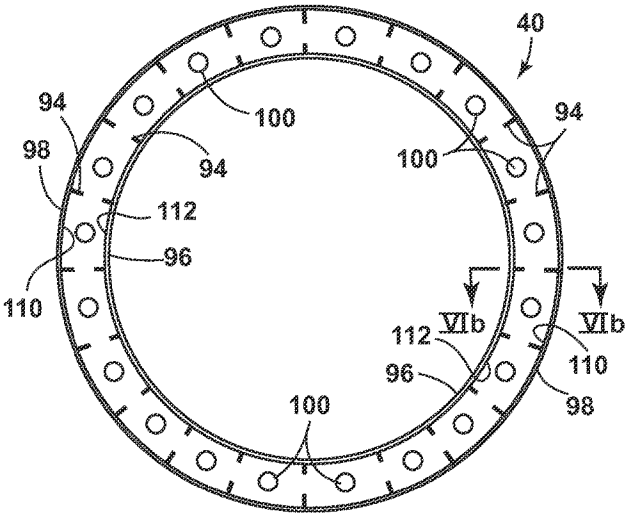
FIG. 5B illustrates a top schematic view of the balance ring assembly with complementary baffles according to a second baffle embodiment of the invention.
Figure 5A:
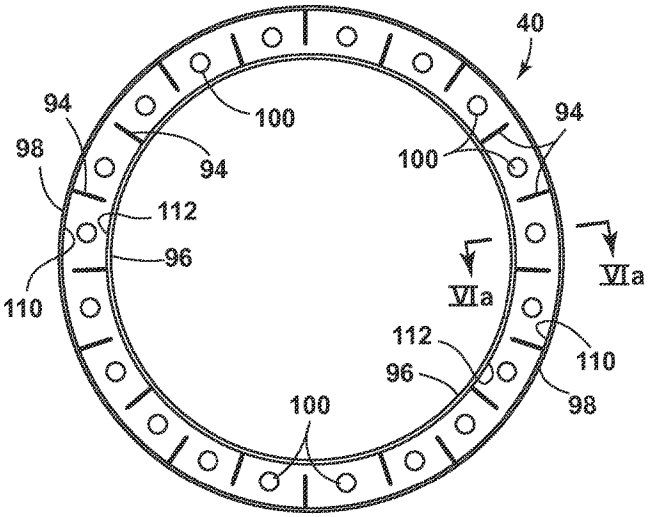
FIG. 5A illustrates a top schematic view of the balance ring assembly with alternating baffles according to a first baffle embodiment of the invention.
Figure 5C:
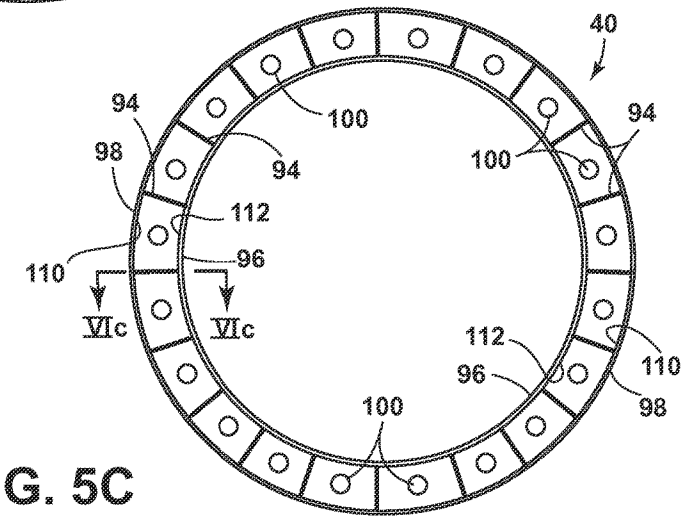
FIG. 5C illustrates a top schematic view of the balance ring assembly with baffles according to a third baffle embodiment of the invention.

FIGS. 5A-5C illustrate three embodiments of the baffles 94 disposed within the annular chamber 90. The balance ring 40, comprising the inner surface 96 and outer surface 98 disposed on the external surfaces of the balance ring 40, further comprises an outer chamber surface 110 and an inner chamber surface 112, disposed within the annular chamber 90 of the balance ring 40. The outer and inner chamber surfaces 110, 112 are surfaces to which one or more baffles 94 can be mounted.

In a first baffle embodiment, in FIG. 5A, the baffles 94 can be disposed alternatively on both the outer and inner chamber surfaces 110, 112, comprising a passage between each baffle 94. The baffles 94 can extend partially, mostly, or completely across the width of the annular chamber 90, defined between the outer and inner chamber surfaces 110, 112. In FIG. 5B, in the second baffle embodiment, a plurality of baffles 94 are disposed across from and complementary to one another along both the outer and inner chamber surfaces 110, 112, having a passage 100 disposed between each complementary set of baffles 94. In the third baffle embodiment, in FIG. 5C, a baffle 94 can be disposed across the entire width of the annular chamber 90 between the outer and inner chamber surfaces 110, 112. This embodiment can comprise baffles 94, which fully seal sections of the balance ring 40. Each section can comprise one or more passages 100, or can include a variable height position, where liquid within the balance ring can flow above or below the baffle 94 being disposed along the top or bottom of, or centrally located within, the annular chamber 90.

Figure 6C:
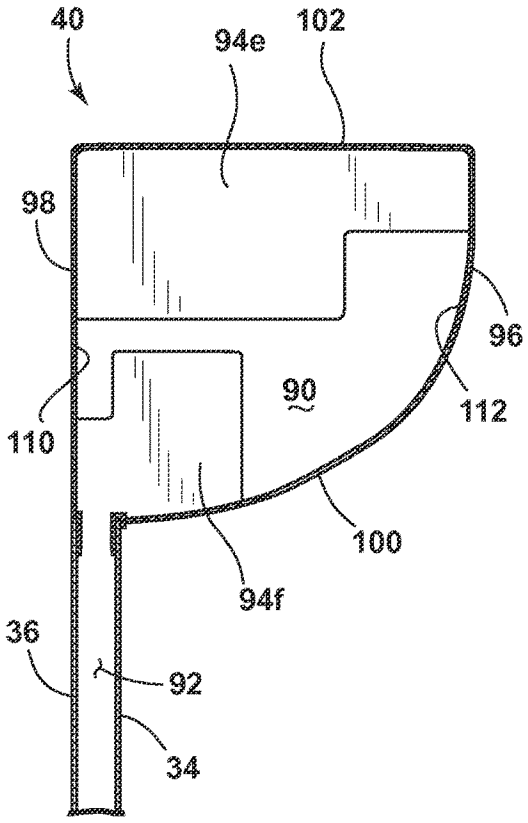
FIG. 6C illustrates a cross-sectional view across section VIc of FIG. 5C, according to the third baffle embodiment of the invention.
Figure 6B:
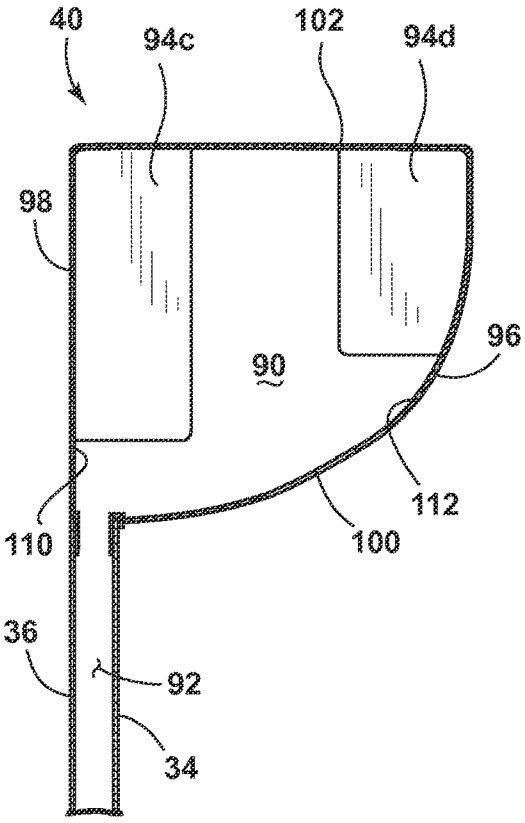
FIG. 6B illustrates a cross-sectional view across section VIb of FIG. 5B, according to the second baffle embodiment of the invention.
Figure 6A:
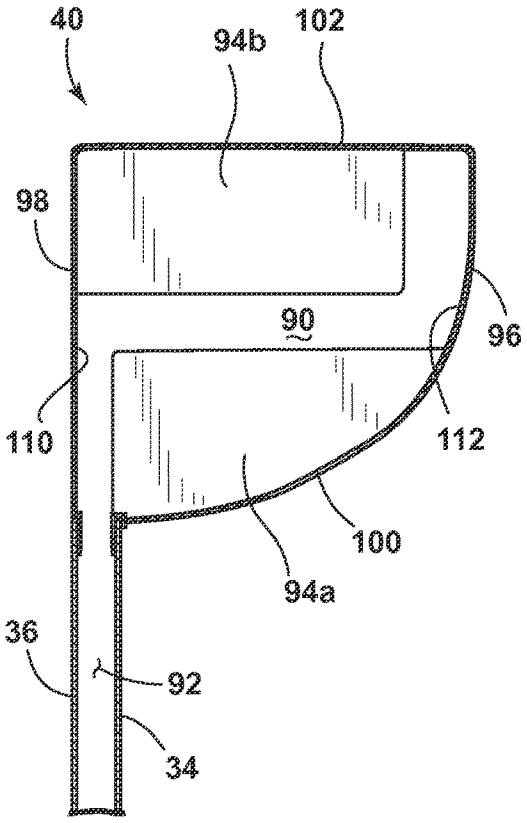
FIG. 6A illustrates a cross-sectional view across section VIa of FIG. 5A, according to the first baffle embodiment of the invention.

Turning to FIGS. 6A-6C, cross-sections VIa-VIc of FIGS. 5A-5C, respectively, are shown. FIG. 6A, at cross-section VIa, illustrates one orientation of baffles 94 according to the first embodiment, comprising alternating baffles 94*a*, 94*b*. The first baffle 94*a* can mount to the inner chamber surface 112, being alternatively disposed between the passages 100 with the second baffles 94*b* mounted to both the outer chamber surface 110 and the underside of the upper surface 102.

FIG. 6B, at cross-section VIb, illustrates another orientation of baffles 94 according to the second embodiment. A third baffle 94*c* mounts to both the outer chamber surface 110 and the underside of the upper surface 102, similar to the second baffle 94*b*, while sharing a greater mounting surface with the outer chamber surface 110 rather than the underside of the upper surface 102. A fourth baffle 94*d* mounts to the inner chamber surface 112 and shares a mounting surface with the underside of the upper surface 102. In this embodiment, the baffles 94*c*, 94*d* can be disposed complementary to and across from one another.

FIG. 6C illustrates the baffles 94 at cross-section IVc, according to the third embodiment of the baffles 94. A fifth baffle 94*e* is disposed along the entire underside of the upper surface 102, connecting the outer chamber surface 110 to the inner chamber surface 112, while a sixth baffle 94*f* connects the outer chamber surface 110 to the inner chamber surface 112 without mounting to the underside of the upper surface 102. The sixth baffle 94*f* partially extends into the space 92 between the inner wrapper 34 and the outer wall 36.

As can be appreciated, the first, second and third embodiments of the baffles 94, as seen in FIGS. 5A-5C and FIGS. 6A-6C, are exemplary. Based upon the size of the laundry appliance, materials used in construction, orientation, spacing, suspension structure, as well as numerous other factors can determine what rotational frequencies, or ranges thereof, can cause an imbalance. Different shapes, orientations, or combinations of baffles 94 can be advantageous in mitigating an imbalance at these ranges. These factors can vary based upon the load, mass of laundry, or otherwise, within the appliance. For example, where a particular appliance can be constructed or tuned to have a critical frequency near 70 rpm, an excessive load within the appliance can change the critical frequency to 50 rpm.

The orientation and combination of baffles 94 can be designed to correct the imbalance condition based upon a range of critical frequencies in which an imbalance is likely to occur. For example, where an imbalance is likely between 50-70 rpm, the system of alternating baffles, similar to the first embodiment seen in FIGS. 5A and 6A, could be advantageous. Alternatively, where an imbalance is likely between 120-140 rpm, baffles 94 similar to that of the third embodiment seen in FIGS. 5C and 6C could be advantageous. As can be appreciated, the organization and orientation of the baffles 94 can be used to tune the balance ring 40 to correct an imbalance which is likely to occur at a wide range of frequencies.

Furthermore, the baffles 94 as shown are substantially quadrilateral. It should be appreciated that the baffles 94 can be of any shape, size, dimension, height, or width, and can be mounted in varying frequencies, positions, and orientations, in combination with the passages 100, or not, as can be determined based upon critical frequencies in which an imbalance condition is likely to occur.

Further still, the shape, construction, or orientation of the balance ring 40 itself can be varied or adapted to treat imbalances occurring at a range of frequencies. In one example, a wider annular chamber 90, defined by a wider upper surface 102, could be advantageous in treating a particular range of imbalance frequencies. Similarly, the size or shape of the passages 100 can be used to treat a particular range of imbalance frequencies. As is appreciable, the balance ring 40, annular chamber 90, baffles 94, and passages 100 all can vary to tune the balance ring 40 to treat a range of imbalance frequencies which can vary based upon the particular appliance.

The baffles 94, in any embodiment, are beneficial for preventing standing waves that can develop within the liquid disposed within the annular chamber 90. In a conventional liquid-filled balance ring 40, the liquid within the balance ring 40 can develop standing waves based upon the structure of the balance ring 40, the amount of liquid within the balance ring 40, as well as the rotational speed of the basket 24. The standing waves which can occur within the annular chamber 90 can prevent the balance ring 40 from returning the washing machine 10 to a balanced state. Utilizing a series of baffles 94 within the balance ring 40 prevents the occurrence of standing waves and other undesirable dynamic effects from occurring in the liquid disposed within the balance ring 40.

Figure 7:
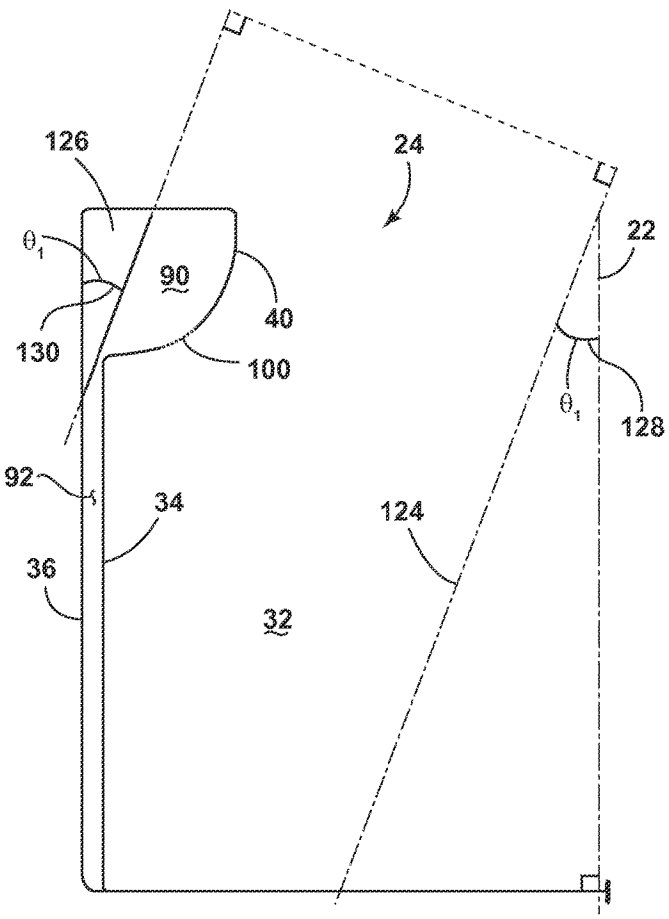
FIG. 7 is a schematic view of liquid in the balance ring assembly during an off-balance condition.

Turning now to FIG. 7, as an imbalance condition occurs, a basket axis of rotation can skew from the vertical axis of rotation 22 to a skewed axis of rotation 124 during an imbalance condition, by a degree of imbalance 128 shown as an angle of imbalance $\theta_1$. As the imbalance occurs, the centrifugal force from the spinning basket 24 will draw liquid from within the treating chamber 32, through the perforations within the inner wrapper 34 and into the space 92 between the inner wrapper 34 and the outer wall 36. As a volume of balance liquid 126 is drawn into the space 92, it can flow upwardly from the space 92 and into the annular chamber 90. The volume of balance liquid 126 drawn into the annular chamber 90 can be directly proportional to the degree of imbalance 128 and can be disposed at a restoring angle 130 directly related to or equivalent to the angle of imbalance $\theta_1$.

Figure 8:
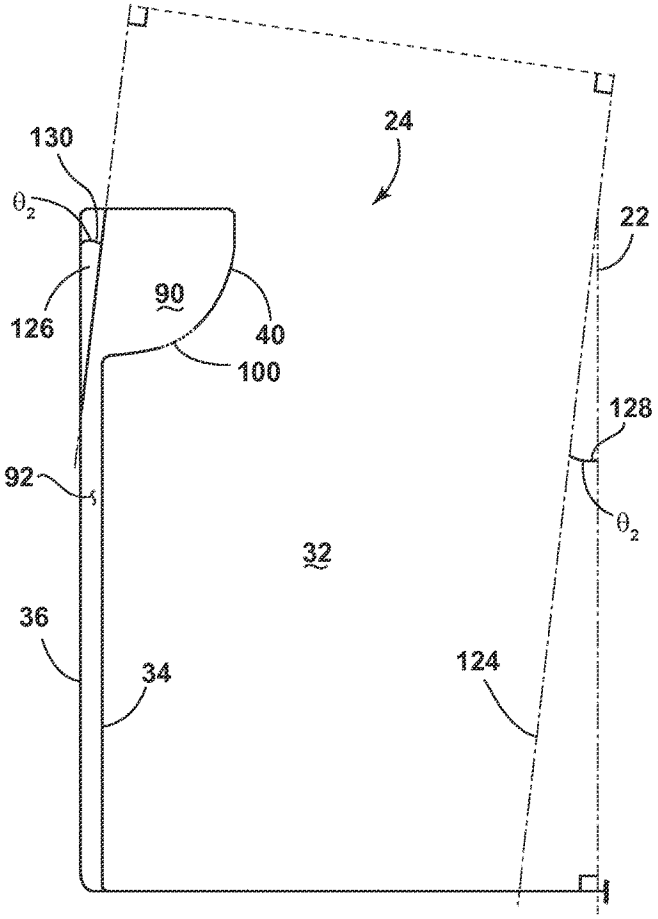
FIG. 8 is a schematic view of liquid in the balance ring assembly as the laundry assembly begins to return to a balanced condition.

Turning to FIG. 8, the balance liquid 126 exerts a restoring force on the basket 24. The restoring force acts to decrease the degree of imbalance 128, as a restored angle of imbalance $\theta_2$ As balance is restored, the angle of imbalance $\theta_1$ will decrease to a restored angle of imbalance $\theta_2$, eventually returning to a balanced condition and aligning the skewed axis of rotation 124 with the initial basket axis of rotation 22. Similarly, as balance is restored, the balance liquid 126 will drain from the annular chamber 90, resulting in a decreased volume of balance liquid 126, completely draining when the washer is balanced. The decreased degree of imbalance 128 can decrease the restoring angle 130 of the volume of the balance liquid 126, remaining directly proportional to or related to the degree of imbalance 128.

In another embodiment, liquid may flow into the annular chamber 90 through the passages 100. Once within the passages 100, the liquid will become a balance liquid 126 and will orient itself at a restoring angle 130 proportional to the degree of imbalance 128. The increased flow of liquid into the annular chamber 90 through the passages could facilitate or hasten the process of restoring the imbalance to a balanced condition.

As the degree of imbalance 128 and the angle of imbalance $\theta_1$ increase, the annular chamber 90 will draw a greater volume of liquid, providing a greater restorative force to the washer. As such, the balance ring 40 can be adaptive to the imbalance condition. The balance ring 40 can restore a wide range of angle of imbalance $\theta_1$ by this adaptive feature. Similarly, where a standard balance ring may operate to restore an imbalance occurring between 50-70 rpm, the inventive balance ring 40 can adapt to an imbalance by selectively drawing liquid to provide a restoring force based upon the occurrence of an imbalance condition rather than providing a restoring force to a predetermined imbalance range. Furthermore, the balance ring 40 automatically drains when the washer is balanced, where a pre-filled balance ring can create or exacerbate an imbalance condition at particular frequencies.

Figure 9:
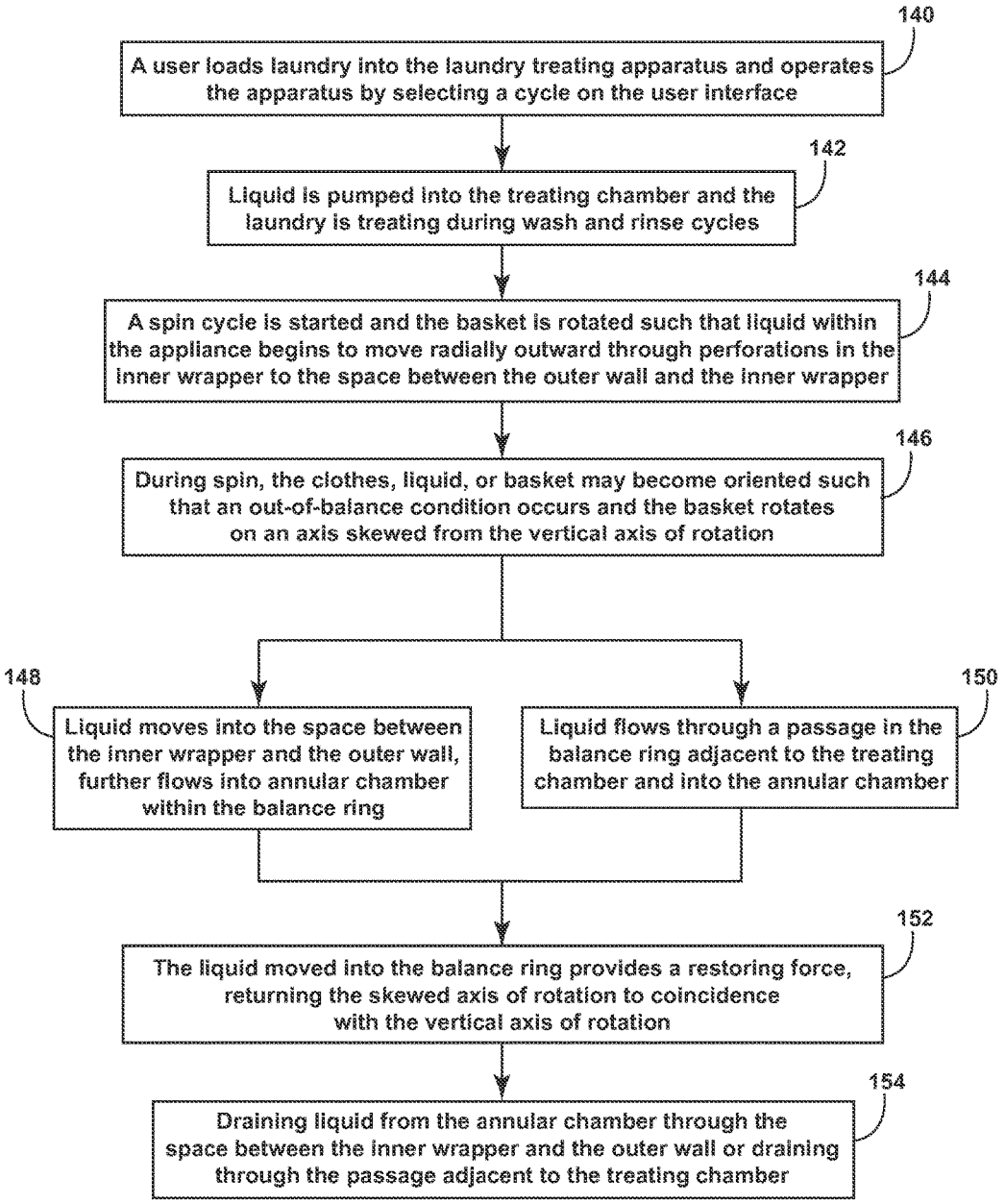
FIG. 9 is a flow chart of the method of operation of the balance ring assembly.

Turning now to FIG. 9, the method of operating the laundry treating appliance to restore balance during an out-of-balance condition comprises, at 140, loading laundry or otherwise into the treating chamber of the laundry treating appliance. A user selects a cycle of operation on the user interface of the appliance and the cycle can begin. At 142, liquid, such as water, treating chemicals, or a combination thereof, is pumped into the treating chamber where the laundry can be treated during wash, rinse, and spin cycles.

At 144, a spin cycle is started and the basket is rotated. The rotation creates a centrifugal force such that liquid within the appliance moves radially outward, through the perforations of the inner wrapper and out into the space between the inner wrapper and the outer wall. While in a balance condition, the liquid within the space can drain from the basket out into the tub, pump, or otherwise. At 146, the rotational speed of the basket, orientation of the laundry within the appliance, or a combination thereof can skew the axis of rotation of the basket such that an imbalanced condition occurs. The skewed axis of rotation will be disposed at an angle of imbalance $\theta$ from the initial basket axis of rotation. From 146, liquid can flow into the annular chamber from two paths.

At 148, liquid drawn radially outward by centrifugal force can move into the space between the inner wrapper and the outer wall. The liquid can flow upwardly from the space and into the annular chamber of the balance ring. The greater the degree of imbalance, the greater the volume of liquid will be drawn into the balance ring. Similarly, at 150, liquid within the treating chamber can flow through the passage on the inner surface of the balance ring into the annular chamber. Additionally, a combination of 148 and 150 can draw liquid into the annular chamber from both the space between the inner wrapper and the outer wall as well as through the passages.

At 152, the liquid, now disposed within the annular chamber, provides a restoring force to the system, acting against the imbalance. The degree of imbalance is directly proportional to the amount of liquid drawn into the annular chamber, such that the restoring force can be directly proportional to the degree of imbalance. The restoring force causes the degree of imbalance to decrease, returning the skewed axis of rotation back towards an initial axis of rotation and a balanced condition. At 154, as the balanced condition returns to the washer and liquid within the annular chamber drains. Eventually, the system will return to a balanced condition, aligned with the initial axis of rotation, and the liquid within the annular chamber will drain through the space and into the tub where the liquid can be removed from or recirculated within the system. Variably, liquid can drain from the annular chamber through the passages and back into the basket.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance for treating laundry according to a cycle of operation, comprising:

a basket defining a treating chamber, including a basket base and an annular, imperforate outer wall extending from the basket base and terminating at an upper end and a perforated inner wrapper concentric with and separated from the outer wall to define an annular intervening space, the basket configured to rotate about a generally vertical axis of rotation; and an annular balance ring circumscribing and located at the upper end of the basket and defining an annular chamber, and having at least one inlet in fluid communication with the intervening space and at least one outlet provided on the balance ring in direct fluid communication with the treating chamber and overlying the basket base, with the annular balance ring provided radially interior of the perforated inner wrapper relative to an axis coincident with the generally vertical axis of rotation;

wherein an out-of-balance condition caused by a skewed axis of rotation of the basket urges a wash liquid from the basket to flow into the annular chamber via the at least one inlet to provide a restoring force to the basket toward a balance condition.

2. A laundry treating appliance according to claim 1 further comprising multiple inlets.

3. A laundry treating appliance according to claim 2 wherein the multiple inlets are spaced from each other at a lower portion of the annular chamber.

4. A laundry treating appliance according to claim 1 further comprising baffles in the annular chamber.

5. A laundry treating appliance according to claim 4 wherein the baffles are arranged in an alternating pattern along a radially inner surface and a radially outer surface of the inside of the annular chamber.

6. A laundry treating appliance according to claim 4 wherein the baffles are arranged in a complementary pattern along a radially inner surface and a radially outer surface inside of the annular chamber.

7. A laundry treating appliance according to claim 4 wherein the baffles are arranged along both an upper surface and a lower surface of the inside of the annular chamber.

8. A laundry treating appliance according to claim 4 wherein at least one of the baffles is at least partially disposed within the space between the outer wall and the inner perforated wrapper.

9. A laundry treating appliance according to claim 1 wherein the at least one outlet is in fluid communication with the treating chamber.

10. A laundry treating appliance according to claim 1 wherein a restoring force increases or decreases relative to an increase or decrease of the degree of the skewed axis of rotation.

* * * * *